US006817925B2

(12) United States Patent
Saigo et al.

(10) Patent No.: US 6,817,925 B2
(45) Date of Patent: Nov. 16, 2004

(54) MULTISTAGE FINE HOLE MACHINING METHOD AND DEVICE

(75) Inventors: Tatsuji Saigo, Chiba (JP); Masaharu Sugiyama, Chiba (JP); Hideo Iwadate, Chiba (JP); Hiroyuki Kihara, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/227,717

(22) Filed: Aug. 26, 2002

(65) Prior Publication Data

US 2003/0045209 A1 Mar. 6, 2003

(30) Foreign Application Priority Data

Sep. 5, 2001 (JP) ..... 2001-269360

(51) Int. Cl.[7] ..... B24C 1/00

(52) U.S. Cl. ..... 451/36; 451/305; 451/296; 451/28; 125/16.02; 125/21

(58) Field of Search ..... 451/36, 305, 296, 451/304, 532, 28; 125/16.01, 16.02, 21, 16.04

(56) References Cited

U.S. PATENT DOCUMENTS 4,866,888 A * 9/1989 Murai et al. ..... 451/533
5,154,022 A * 10/1992 Chalco et al. ..... 451/36
5,816,902 A * 10/1998 Watanabe et al. ..... 451/532
5,913,305 A * 6/1999 Hauser ..... 125/16.02
6,041,766 A * 3/2000 Vojtechovsky ..... 125/16.02
6,119,319 A * 9/2000 Redman et al. ..... 26/28
6,443,143 B1 * 9/2002 Ishida et al. ..... 125/16.02
6,568,384 B1 * 5/2003 Onizaki ..... 125/16.02

* cited by examiner

*Primary Examiner*—Lee D. Wilson
(74) *Attorney, Agent, or Firm*—Adams & Wilks

(57) ABSTRACT

A multistage fine-hole machining device has lap stations for lapping an inner surface defining a through-hole of a workpiece. Each of the lap stations has a passing unit for passing wire through the through-hole of the workpiece, a supply unit for supplying a polishing material to the wire, and a sliding unit for effecting relative sliding movement between the workpiece and the wire while the wire is passed through the through-hole of the workpiece and is supplied with the polishing material to thereby lap the inner surface of the workpiece with the polishing material and enlarge the diameter of the through-hole. A transfer device successively transfers the workpiece to each of the lap stations to lap the inner surface of the workpiece at each of the lap stations during the lapping operation for successively enlarging the diameter of the through-hole to a preselected diameter.

24 Claims, 6 Drawing Sheets

PRIOR ART
FIG. 8A
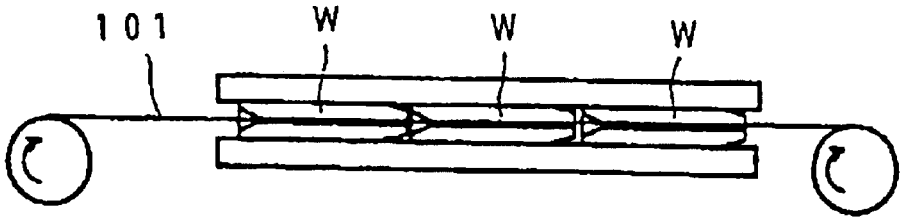
PRIOR ART
FIG. 8B
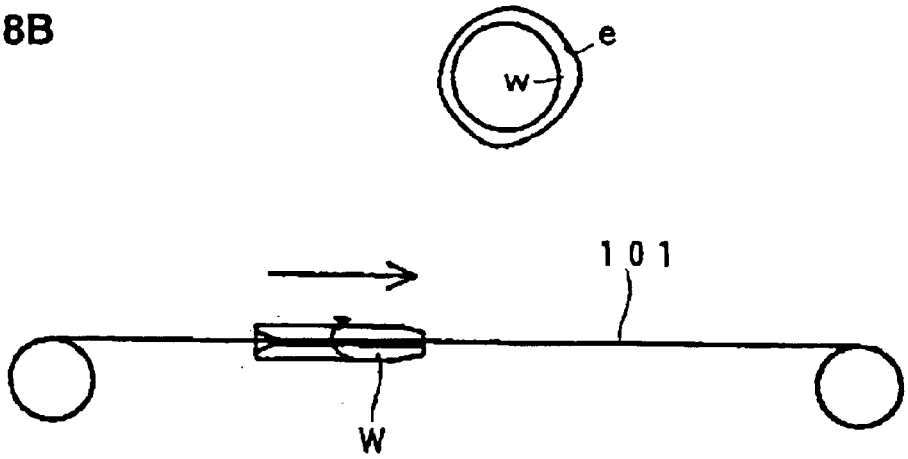
FIG. 9
PRIOR ART
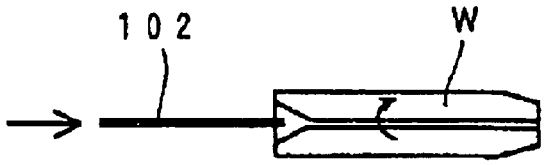
FIG. 10
PRIOR ART

MULTISTAGE FINE HOLE MACHINING METHOD AND DEVICE

BACKGROUND OF THE INVENTION

1. Field of the Invention

The present invention relates to a fine hole machining method and device for polishing the inner surface of a fine hole such as a ferrule of an optical fiber connector.

2. Description of the Related Art

A ferrule of an optical fiber connector is made of a zirconia-type ceramic material or the like, and a fiber insertion hole with a small diameter is formed in an axial direction thereof. An optical fiber is inserted into the fiber insertion hole and held and fixed thereto. The diameter of the fiber insertion hole is generally 125 to 128 $\mu$m, and the roundness of the hole and the taper (sagging) of an edge of the hole are required to be several $\mu$m or less.

A hole is formed in a ferrule material (workpiece) using zirconia ($ZrO_2$) by extrusion molding or injection molding. As a fine hole machining method for subjecting the hole to lapping to form a fiber insertion hole, the following methods are known: (1) one taper wire 101 is inserted into a plurality of materials W, W, . . . , relative rotation and relative sliding are given between the materials W, W, . . . , and the taper wire 101, and a plurality of materials W, W, . . . are subjected to lapping together with diamond powder on the periphery of the taper wire 101 (see FIG. 8A) (JP 11-048105 A); (2) the taper wire 101 is inserted into one material W, relative rotation and relative sliding are given between the material W and the taper wire 101, and the hole of the material W is subjected to lapping one by one with diamond powder on the periphery of the taper wire 101 (see FIG. 9) (JP 3062939); and (3) a straight wire 102 is used as a drill, and the hole of the material W is subjected to lapping one by one with diamond powder on the periphery of the straight wire 102 (see FIG. 10).

According to the above-mentioned methods (1) and (2) using a taper wire, the taper precision of the taper wire is required. However, it is difficult to produce a taper wire satisfying such a required precision, which results in degradation of a hole machining precision. In particular, according to the method (1) with high productivity, materials are held on the basis of the outer diameter thereof, and the taper wire is inserted into the materials, as shown in FIG. 8A. Therefore, the taper wire is slightly bent between adjacent materials due to the central shift between the outer diameter of the materials and the holes. Under this condition, the taper wire is provided with tension, and lapping is conducted while relative rotation and relative sliding are performed. Therefore, as shown in FIG. 8B, edge sagging of a hole "w" and non-uniformity of the hole "e" are likely to occur. The central shift of the materials is generally 10 to 20 $\mu$m.

According to the method (3) using a straight wire, the hole diameter that can be enlarged by machining is at most about 2 $\mu$m. Therefore, although this method can be used for correcting the hole diameter, it is not applicable to machining of the hole of a material into a fiber insertion hole (grinding hem: tens of $\mu$m).

SUMMARY OF THE INVENTION

Therefore, with the foregoing in mind, it is an object of the present invention to provide a multistage fine hole machining method and device capable of realizing high-precision fine hole machining without edge sagging and non-uniformity of the hole in a short cycle time.

In order to achieve the above-mentioned object, according to the method of the present invention, in a lapping process of passing a wire through a hole of a workpiece and lapping the hole with a polishing material placed between the hole and the wire while the hole and the wire are allowed to be relatively slid, the hole is enlarged, and the workpiece with the hole enlarged is subjected to the lapping process repeatedly to enlarge the hole successively, whereby a desired hole diameter is obtained.

In the above-mentioned method of the present invention, a wire thicker than that in a previous process is used for the workpiece with the hole enlarged or a polishing material with an average particle diameter larger than that of the polishing material used in the previous process is used, whereby the lapping process is repeated.

Furthermore, in the above-mentioned method of the present invention, in a final lapping process, a polishing material with an average particle size smaller than that of the polishing material used in the previous lapping process is used, whereby a machining efficiency and a machining precision can be further enhanced.

According to the above-mentioned method of the present invention, if a hole cleaning process of cleaning a hole of the workpiece that has been machined by lapping in a previous process is provided, and furthermore, a hole diameter inspecting process of inspecting a hole diameter of the workpiece machined by lapping in the previous process is provided, automated fine hole machining that does not require cleaning in the course of machining and labor of inspection can be conducted.

In a device of the present invention, each of a plurality of hole lap stations for enlarging a hole diameter of a workpiece includes: a workpiece holding unit for holding a workpiece; a wire supply unit for supplying a wire; a wire passing unit for passing an end portion of the wire supplied from the wire supply unit through the hole of the workpiece; a tension providing unit for providing tension to the wire passed through the hole of the workpiece by the wire passing unit; a polishing material supply unit for supplying a polishing material to the wire; and a wire/workpiece relative sliding unit for relatively sliding the wire supplied with the polishing material and provided with tension and the workpiece held by the workpiece holding unit. The workpiece with the hole enlarged in one hole lap station is transferred to another hole lap station, whereby the hole is successively enlarged to obtain a desired hole diameter.

In the above-mentioned device of the present invention, the workpiece holding unit can be provided on a workpiece transport device for placing the workpiece at a wire insertion position for passing the wire through the hole and delivering the workpiece from the wire insertion position.

If the workpiece transport device is designed as an index board that performs an index operation between the wire insertion position and the workpiece supply/discharge position, and an inter-station transport device is provided, which transports a workpiece that has been lapped to a hole lap station in a subsequent process at the workpiece supply/discharge position and supplies the workpiece from a previous process, supply/discharge of the workpiece can be automated.

Supply/discharge of a workpiece may also be automated as follows: a plurality of hole lap stations are placed at an equal interval on a circumference, the workpiece transport device is an index table in which a plurality of workpiece holding units are placed so as to correspond to the hole lap stations, and the workpiece holding unit is successively sent to an adjacent hole lap station by an index operation of the index table.

These and other advantages of the present invention will become apparent to those skilled in the art upon reading and understanding the following detailed description with reference to the accompanying figures.

BRIEF DESCRIPTION OF THE DRAWINGS

In the accompanying drawings:

FIG. 8A is a vertical cross-sectional view schematically showing a machining state by a conventional fine hole machining device, and FIG. 8B is a front view of a machined fine hole;

FIG. 9 is a vertical cross-sectional view schematically showing a machining state by a conventional fine hole machining device; and FIG. 10 is a vertical cross-sectional view schematically showing a machining state by a conventional fine hole machining device.

DESCRIPTION OF THE PREFERRED EMBODIMENTS

Hereinafter, a multistage fine hole machining device and method according to the present invention will be described by way of embodiments with reference to the drawings.

Figure 1:
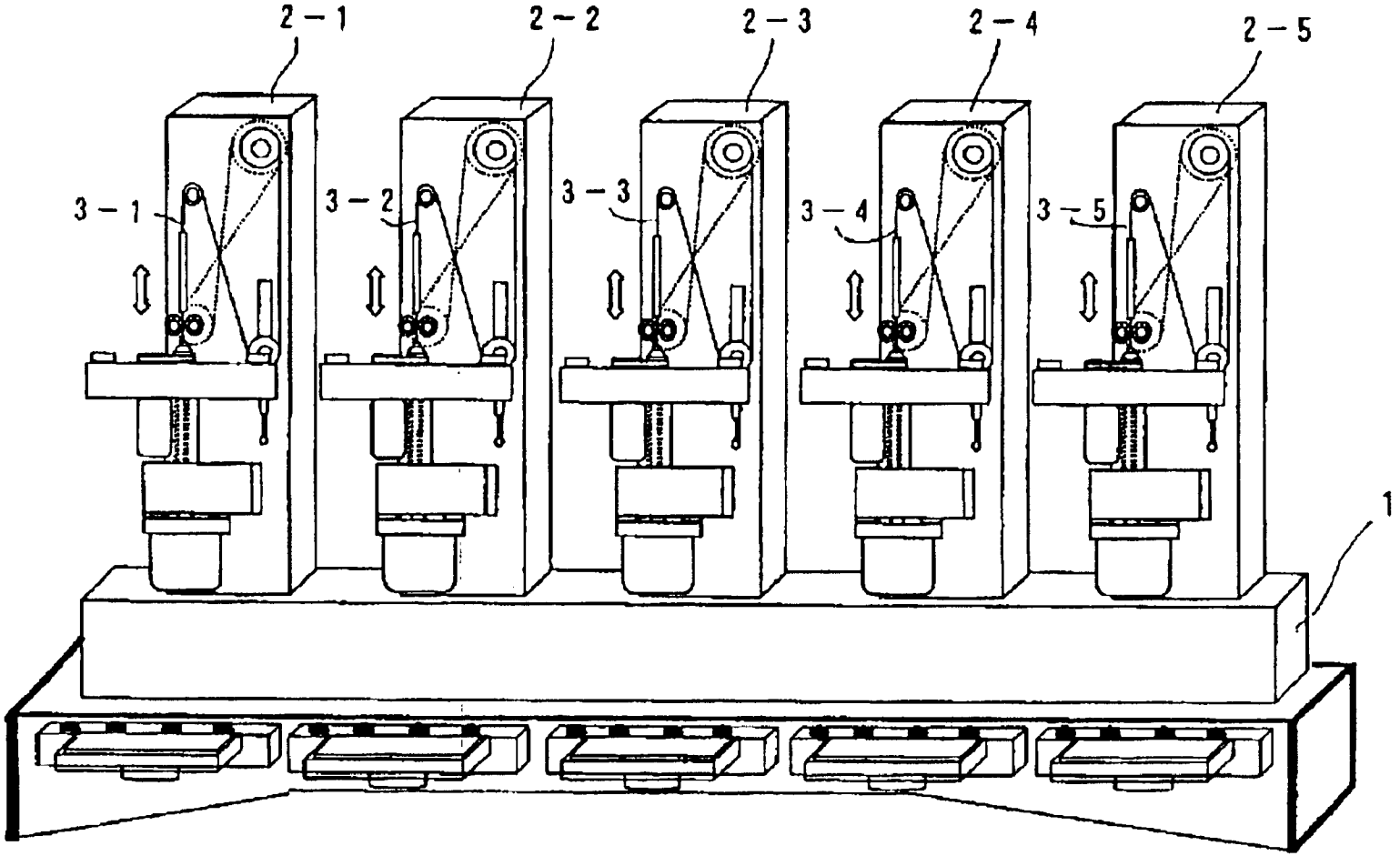
FIG. 1 is a perspective view showing one embodiment of a multistage fine hole machining device according to the present invention.
Figure 2:
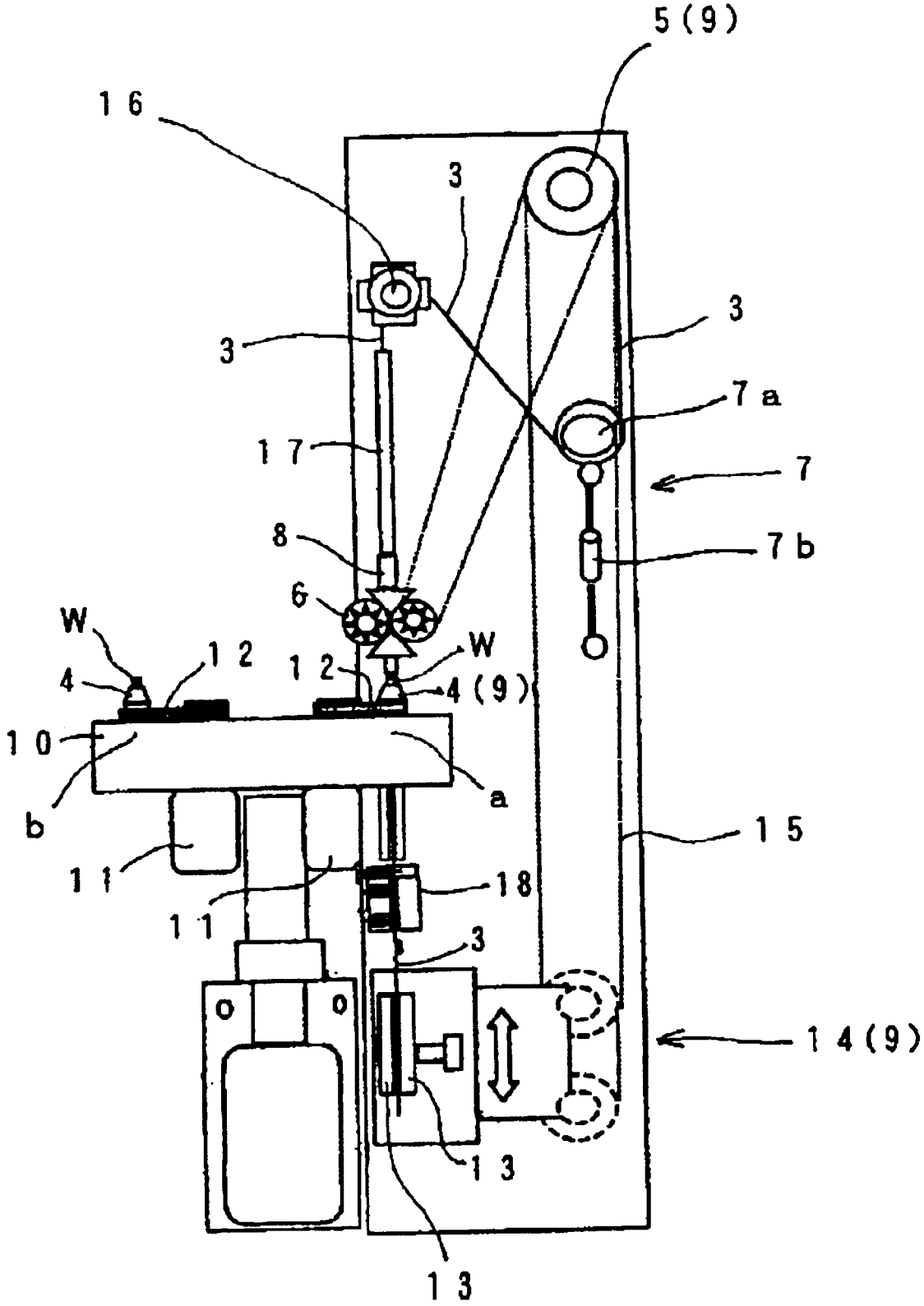
FIG. 2 is a side view showing one hole lap station of the multistage fine hole machining device in FIG. 1.
Figure 3:
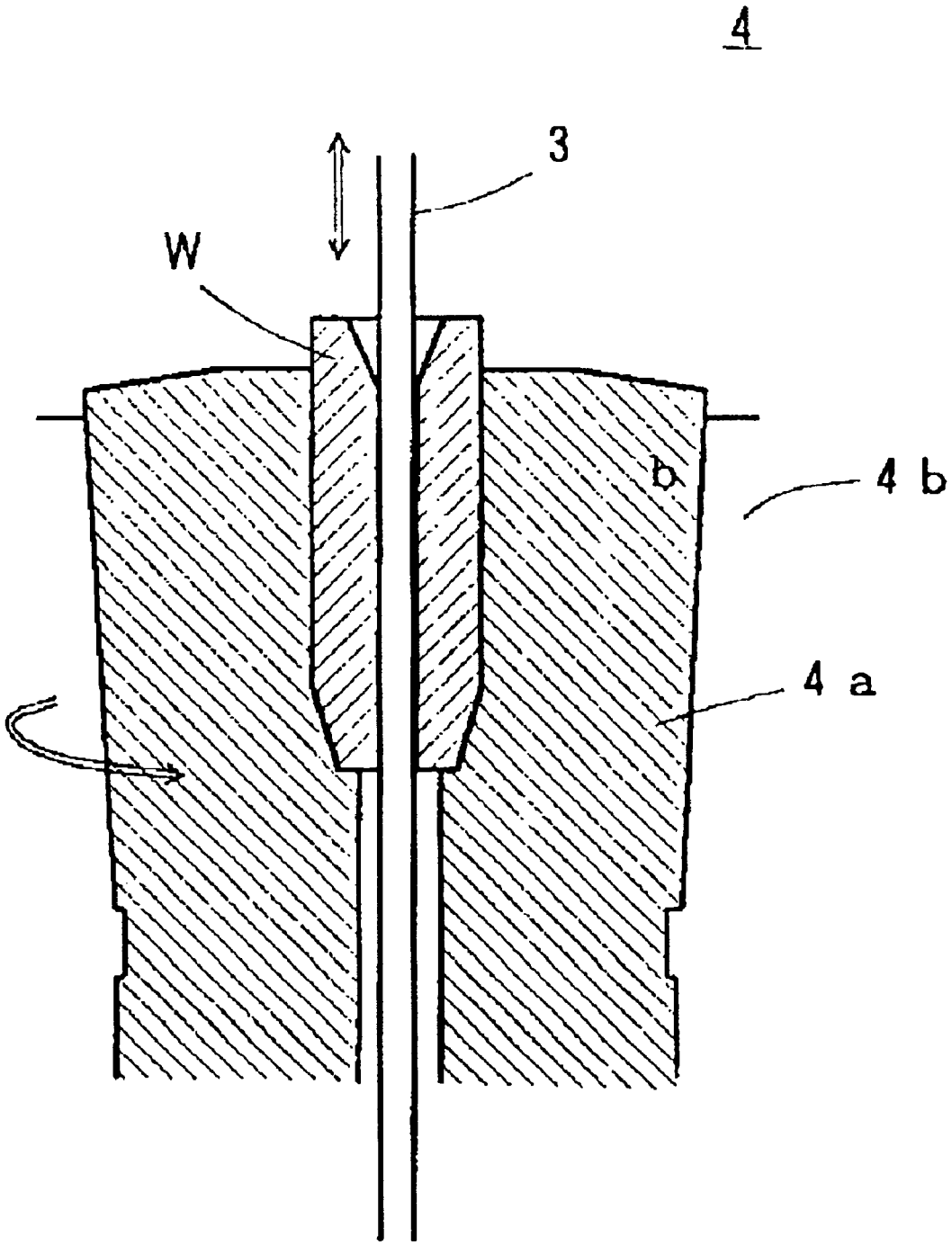
FIG. 3 is a side cross-sectional view showing a workpiece holding unit of the hole lap station in FIG. 2.
Figure 4:
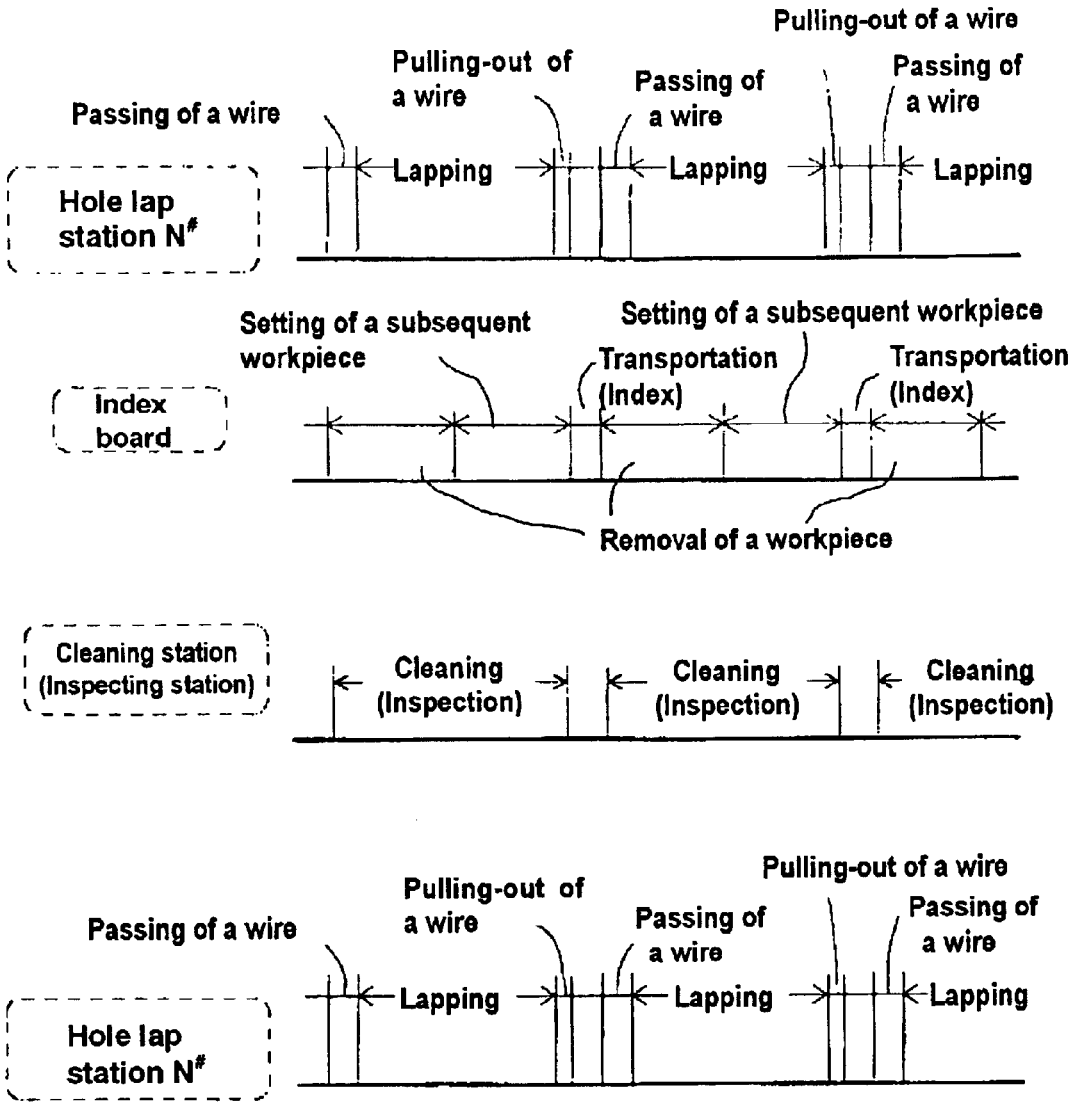
FIG. 4 is a timing chart in the multistage fine hole machining device in FIG. 1.
Figure 5:
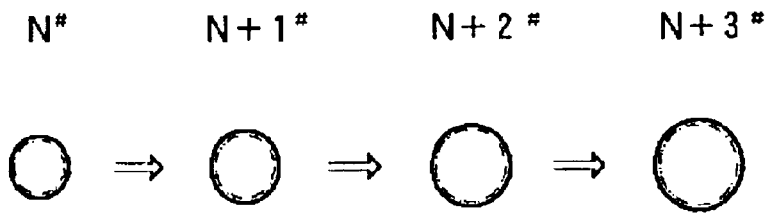
FIG. 5 is a view schematically illustrating a hole machining process in the multistage fine hole machining device according to the present invention.

FIG. 1 is a perspective view showing a first embodiment of the multistage fine hole machining device according to the present invention. FIG. 2 is a side view showing one hole lap station of the multistage fine hole machining device in FIG. 1. FIG. 3 is a side cross-sectional view showing a workpiece holding unit of the hole lap station in FIG. 2. FIG. 4 is a timing chart in the multistage fine hole machining device of FIG. 1. FIG. 5 is a view schematically illustrating a hole machining process.

In the multistage fine hole machinging device shown in FIG. 1, a plurality of hole lap stations 2-1, 2-2, . . . are attached to a base 1 in a line shape. In each of the lap stations, one workpiece (incomplete ferrule made of $ZrO_2$ in this embodiment) is set, a lower hole of a fiber insertion hole with a small diameter is subjected to lapping by a corresponding one of the wires 3-1, 3-2, . . . which has a straight shape made of high-tension piano wire and diamond powder (polishing material) attached to the periphery thereof, whereby the hole diameter thereof is enlarged. The average particle diameter of the diamond powder is about 0.5 to 5.0 $\mu$m.

Lapping is conducted simultaneously in the respective stations. When machining at the stations is completed, i.e., when the diameter of the lower hole of the ferrule is ground by about 1.0 to 10.0 $\mu$m, and the lower hole cannot be ground any more, machining is stopped simultaneously. Then, the wire 3 is pulled out from the lower hole of the ferrule. The ferrule is transported to and set at a hole lap station on the right adjacent side by an inter-station transport device (not shown). At this time, a ferrule material that has just been extruded is set at the hole lap station 2-1 on the most left side by the inter-station transport device, while a ferrule machined by the hole lap station 2-5 on the most right side and provided with a fine hole is taken out.

The wire 3 at the hole lap station on the right adjacent side is thicker than that of the hole lap station that has finished machining. When a ferrule is set at respective hole lap stations 2-1, 2-2, . . . , wires 3-1, 3-2, . . . are inserted into fine holes thereof, and lapping is conducted simultaneously.

Thus, a ferrule is successively transferred to the hole lap stations 2-1, 2-2, . . . , and the fine hole thereof is enlarged by about 1.5 to 2 $\mu$m at each station, whereby a desired hole diameter is obtained at the final station. In FIG. 1, for simplicity, five stations are used. However, in general, the hole diameter of a ferrule material for extrusion molding is about 100 $\mu$m, and the diameter of a fiber insertion hole to be obtained is about 125 to 128 $\mu$m. Therefore, about 3 to 28 stations are arranged and connected to each other by an inter-station transport device.

Next, a machining unit of each hole lap station 2 will be described in detail with reference to FIG. 2.

In FIG. 2, reference numeral 4 denotes a workpiece holding unit for holding a ferrule W, 5 denotes a wire reel (wire supply unit) wound by a wire 3, 6 denotes a wire passing unit for passing an end portion of the wire 3 winding around the wire reel 5 through a hole of the workpiece W, 7 denotes a tension providing unit for providing tension to the wire 3 passing through the hole of the workpiece W by the wire passing unit 6, 8 denotes a polishing material supply unit for supplying diamond powder, and 9 denotes a wire/workpiece relative sliding unit that is supplied with diamond powder by the polishing material supply unit 8 and allows the wire 3 provided with tension by the tension providing unit 7 and the workpiece W held by the workpiece holding unit 4 to relatively slide, thereby subjecting the hole of the workpiece W to lapping to enlarge the hole.

A pair of the workpiece holding units 4 are provided on an index board 10. The workpiece holding units 4 grasp each ferrule W by a chuck 4*a* so as to allow the ferrule W to pass therethrough (see FIG. 3), and are supported by a rolling bearing or the like (not shown) to have a rotatable main axis structure. Reference numeral 11 denotes a motor for rotating and driving the workpiece holding unit 4. The rotation of the motor 11 is sent to a main axis 4*b* of each workpiece holding unit 4 via a belt 12, and the main axis 4*b* is rotated while grasping the ferrule W. The chuck 4*a* is opened/closed by an air pressure.

The index board 10 is designed so as to perform an index operation by 180° between a wire insertion position "a" and a workpiece supply/discharge position "b". At the wire insertion position "a", the wire 3 is inserted into the hole of the ferrule W for subjecting the ferrule W to lapping. At the workpiece supply/discharge position "b", the ferrule W is set at the workpiece holding unit 4, and the ferrule W subjected to lapping is removed to be transferred to a subsequent station.

The wire reel 5 wound by the wire 3 reels out the wire 3 so as to supply it to the workpiece holding unit 4 side for lapping. Moreover, the wire reel 5 repeats reeling out and taking up the wire 3, thereby providing relative sliding in an axial direction to the wire 3 and the ferrule W (part of the wire/workpiece relative sliding unit 9) during lapping, and takes up the wire 3 after lapping and pulls it out from the hole of the ferrule W. The wire reel 5 is conventionally known.

The wire passing unit 6 sandwiches the end portion of the wire 3 between a pair of rollers, and rotates the rollers to pass the wire 3 through the hole of the ferrule W. During lapping, the rollers are detached from the wire 3. The wire passing unit 6 is conventionally known.

The tension providing unit 7 has a tension pulley 7*a* for taking up the wire 3 reeled out from the wire reel 5 and a spring 7*b* for pulling the tension pulley 7*a* downward in the figure, and always provides tension to the wire 3 sliding in a reciprocating manner during lapping. The tension providing unit 7 is conventionally known.

The polishing material supply unit 8 allows paste diamond powder mixed with oil to be contained in a felt, and presses the felt to the wire 3 from a side surface, thereby supplying the periphery of the wire 3 with the diamond powder. The polishing material supply unit 8 is conventionally known.

In the present embodiment, the wire/workpiece relative sliding unit 9 is composed of the wire reel 5 that repeats reeling out and taking up the wire 3 during lapping, the workpiece holding unit 4 for relatively rotating the ferrule W with respect to the wire 3, and a wire traverse device 14 that is guided by an LM guide (linear motion guide) to be moved up and down while the end portion of the wire 3 passing through the ferrule W is clamped with a gripper 13. The wire traverse device 14 is driven up and down in synchronization with the wire reel 5 by the belt 15 during lapping.

Although not shown, the inter-station transport device for transporting the ferrule W between the workpiece supply/discharge positions "b" of the respective hole lap stations 2-1, 2-2, . . . is provided before the base 1 in FIG. 1. The transport mechanism of the inter-station transport device is known. That is, according to the transport mechanism, the ferrule W is grasped by an air pressure or mechanically so as to be transported in a reciprocating manner between the workpiece supply/discharge positions "b".

Reference numeral 16 denotes an intermediate pulley. The wire 3, which is reeled out from the wire reel 5 and winds around the tension pulley 7*a,* further winds around the intermediate pulley 16. Reference numeral 17 denotes a wire guide for guiding the wire 3, and 18 denotes a wire cutting device. The wire cutting device 18 cuts a worn-out end portion of a wire when the wire is worn out, thereby allowing a new portion of the wire to be reeled out for use. The wire cutting device 18 is not directly related to the present invention, so that the description thereof will be omitted here.

The operation of the multistage fine hole machining device structured as described above will be described below with reference to FIGS. 4 and 5.

At the beginning of machining, first, the ferrule material W is set and chucked at the workpiece holding unit 4 of the hole lap station 2-1 in a first process. More specifically, the ferrule material W transported by the inter-station transport device is passed to the workpiece holding unit 4 at the workpiece supply/discharge position "b" of the index board 10, and the index board 10 performs an index operation by 180°, thereby positioning the workpiece holding units 4 at the wire insertion position "a".

Then, the end portion of the wire 3 with a diameter slightly smaller than that of the hole of the ferrule material W is inserted into the hole of the ferrule W by the wire passing unit 6 and passed therethrough. The end portion of the passing wire 3 is clamped by the gripper 13 of the wire traverse device 14. In this state, the wire 3 is provided with moderate tension by the tension unit 7 ("Passing of a wire" in FIG. 4).

The ferrule material W is rotated by the workpiece holding unit 4, and the wire 3 is slid in a reciprocating manner by the wire/workpiece relative sliding unit 9. The hole of the ferrule material W and the wire 3 are relatively slid, and the hole of the ferrule material W is lapped with diamond powder disposed between the hole and the wire by the polishing material supply unit 8. Because of this, the hole diameter is enlarged by about 1.5 to 2 $\mu$m ("Lapping" in FIG. 4).

When lapping is completed, the gripper 13 of the wire transverse device 14 releases the wire 3, and the wire reel 5 takes up the wire 3 and removes the wire 3 from the hole of the ferrule material W ("Pulling-out of a wire" in FIG. 4).

In this state, the index board 10 performs an index operation by 180° ("Transportation (Index) in FIG. 4). The ferrule W with the hole enlarged after the completion of the first process is returned to the workpiece supply/discharge position "b". Then, the ferrule W is moved to the station 2-2 in a second process by a reciprocating operation of the inter-station transport device (Removal of a workpiece" in FIG. 4). A new ferrule material W that has not been machined is set at the station 2-1 in the first process (Setting of a subsequent workpiece" in FIG. 4).

In the second process, a wire thicker than that in the first process is used, whereby the gap between the ferrule W and the hole is rendered substantially the same as that in the first process. Even in the station 2-2 in the second process, lapping is conducted by the operation similar to that in the first process, whereby the hole of the ferrule W is further enlarged.

As described above, the processes at the hole lap stations 2-1, 2-2, . . . are repeated, whereby the hole of the ferrule W is successively enlarged at the hole lap stations $N^{\#}$, $N+1^{\#}$, $N+2^{\#}$, . . . , as shown in FIG. 5. Thus, a fiber insertion hole with a desired diameter can be obtained with lapping of a large grinding hem as a whole.

When the first ferrule W enters the final process, lapping proceeds simultaneously at all the hole lap stations 2-1, 2-2, . . . , and thereafter, lapping is continued simultaneously. A time required for one lapping process is 20 seconds or less, including a transport time before and after and a setting time. Therefore, one ferrule is completed in 20 seconds or less, resulting in remarkable enhancement of productivity, compared with a conventional example.

Because of the use of a straight wire with a good size precision and lapping of each ferrule, ferrules are lapped uniformly, and sagging of a hole edge of a ferrule and non-uniformity of a hole do not occur. Furthermore, a variation of a hole diameter is 1 $\mu$m or less. Thus, a high-quality ferrule can be produced.

Next, a second embodiment of the present invention will be described.

Figure 6:
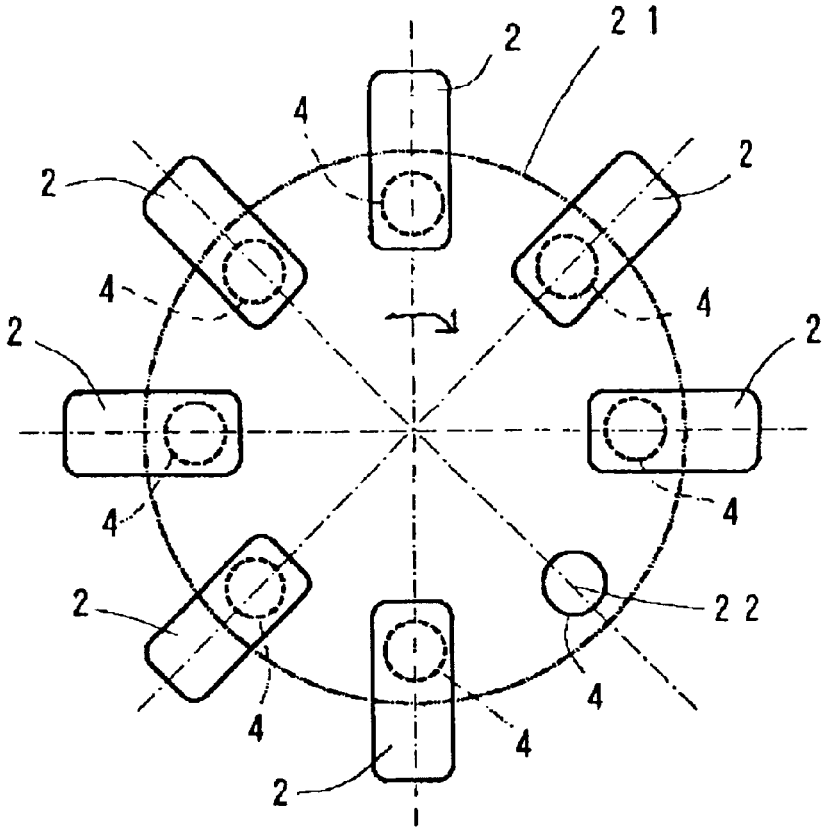
FIG. 6 is a front view showing another embodiment of the multistage fine hole machining device according to the present invention.

In FIG. 6, a plurality of hole lap stations 2, 2, . . . , are placed in an annual shape along an index table 21. Although each hole lap station 2 has the same function as that shown in FIG. 2, it does not use an index board, and the workpiece holding unit 4 is placed on the index table 21. In the case of FIG. 6, because of an index operation by the rotation of 1/(number of hole lap stations+1) of the index table 21, a ferrule is successively sent to an adjacent hole lap station.

The ferrule W is supplied and discharged at a workpiece supply/discharge station 22 placed at a partition position where there is no hole lap station. More specifically, during lapping of the hole lap station 2, an arm of a transport device (not shown) is moved to the workpiece supply/discharge station 22, a completed ferrule is taken out, and a ferrule material that has not been machined is supplied.

Figure 7:
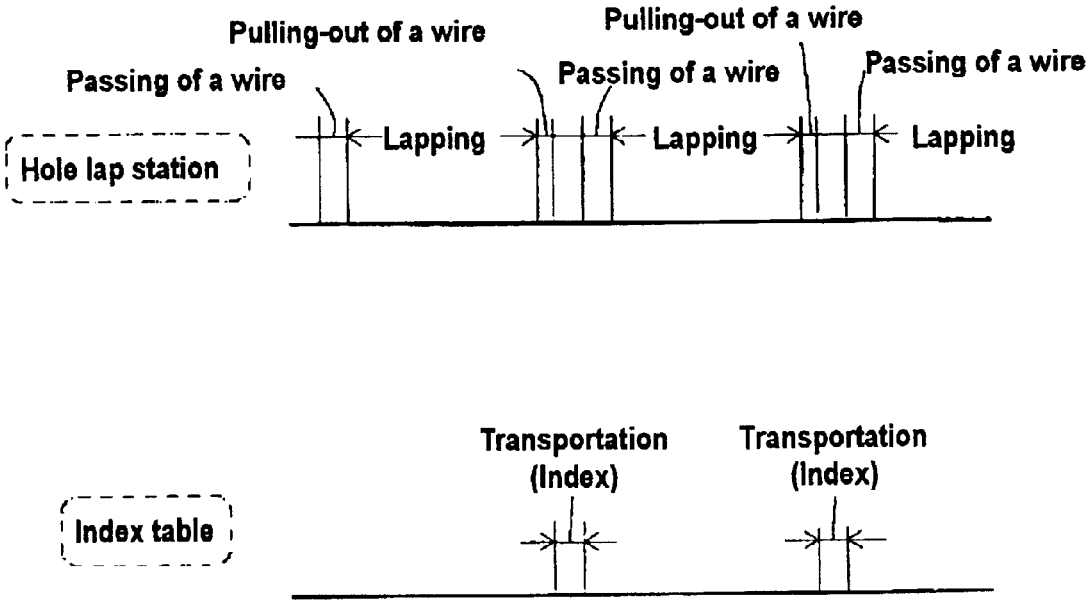
FIG. 7 is a timing chart in the multistage fine hole machining device in FIG. 2.

FIG. 7 is a timing chart in the multistage fine hole processing device in FIG. 6. In the multistage fine hole processing device in FIG. 6, during a lapping process (passing of a wire, lapping, removing of a wire) at each hole lap station 2, an index operation of the index table 21 is conducted.

Even in the index table type multistage fine hole machining device, a ferrule with a high precision can be machined in the same way as in the linear multistage fine hole machining device in FIG. 1. Since a ferrule must be supplied/discharged during a period of transportation (index) of the index table in FIG. 7, a cycle time is somewhat extended compared with the linear multistage fine hole machining device using the index board in FIG. 1 in which lapping and supply/discharge of a ferrule can be partially conducted in parallel. However, compared with a conventional fine hole machining device, a ferrule can be produced much more efficiently.

In the above-mentioned embodiment, the case has been described where a grinding hem is made uniform by using the same diamond powder with an average particle diameter at each station. However, as the average particle diameter of the diamond powder becomes larger, a machining speed is increased and a surface to be machined of a hole becomes rough. In contrast, when the average particle diameter becomes smaller, a machining speed is decreased, and a surface to be machined of a hole becomes fine. If the average particle diameter is successively decreased as the process proceeds, and a grinding hem is decreased (i.e., in the final lapping process, diamond powder with an average diameter of about 0.5 $\mu$m is used, and in the initial lapping process, diamond powder with an average diameter of 5.0 $\mu$m is used), a machining efficiency is further enhanced, and a machining precision can be further increased.

Furthermore, in the above-mentioned embodiment, the case where a hole lap station is placed at each station has been described. However, in fine hole lapping, ground cuttings are likely to remain in a hole, which may decrease a machining efficiency and degrade a machining precision. Although not shown, a hole cleaning station for cleaning a hole that has been lapped can be placed alternately with a hole lap station, for example, whereby a cleaning station can be placed between lapping in a previous process and lapping in a subsequent process. Alternatively, a cleaning station for cleaning a hole of a workpiece that has been machined during lapping in the previous process can be provided after the final lapping process. Because of this, a lap machining efficiency is further enhanced, and a machining precision can be further enhanced.

Furthermore, a station in a hole diameter inspecting process of passing an inspection gage through a hole can be provided between lapping processes, between a cleaning process and a subsequent lapping process, after the final lapping process, or after the final cleaning process. Because of this, a defective product can be checked in the course of machining, and a defect in machining can be found at an initial stage.

In the above-mentioned embodiment, as the lapping process proceeds, the hole diameter of a wire is enlarged by increasing a wire diameter. However, according to the present invention, even if wires with the same diameter are used at respective hole lap stations, the average particle diameter of a polishing material is increased as the lapping process proceeds, different kinds of polishing materials are used, the relative sliding speed between a workpiece and a wire is enhanced, a lap time is extended, or a combination thereof is conducted, the diameter of a fine hole of a workpiece can be enlarged in a multistage lapping process.

As the wire supply unit, in addition to the above-mentioned wire reel, a container containing a plurality of short wires, in which a bottom is tapered so that a wire is grasped by a collet chuck one at a time and pulled out like a knock-type mechanical pencil, can be used.

Furthermore, as the polishing material, in addition to diamond powder mixed in oil, diamond powder mixed in a water-soluble grinding liquid, GC (green carbon) grains mixed in oil, and the like can be used. Furthermore, two or more kinds of polishing particles with different average particle diameters may be mixed to be used as a polishing material. In the case of the polishing material in which two or more kinds of polishing particles are mixed, a lap efficiency and a lap finishing surface may be enhanced depending upon selection conditions, and it maybe effective to selectively use such a polishing material during coarse lapping process and final lapping process.

The arrangement of the hole lap station 2, cleaning station, and hole diameter inspecting station in the present invention are not limited to a type in which a ferrule is sent to an adjacent station in the above-mentioned linear arrangement or circumferential arrangement. Depending upon the situation of a process, stations may be placed appropriately in a linear arrangement, a circumferential arrangement, a staggered arrangement, a rectangular arrangement, or the like and the ferrule may be sent in an appropriate order. However, as in the above embodiment and the embodiment described below, if the difference in hole diameter of workpieces to be machined at hole lap stations placed adjacent to each other is set to be smaller than that of workpieces to be machined at hole lap stations that are not adjacent to each other, a transport efficiency of the workpiece is further enhanced.

A workpiece to be targeted for fine hole machining of the present invention is not limited to a ferrule. The present invention is preferable for machining a ferrule made of $ZrO_2$, other engineering plastic material, a glass material, a stainless material, and like.

As described above, according to the present invention, a wire is passed through a hole of a workpiece at a plurality of hole lap stations, the hole is lapped with a polishing material between the hole and the wire while the hole and the wire are relatively slid, and the workpiece is transferred to a subsequent hole lap station after the completion of machining and is lapped, whereby the hole is successively enlarged so as to obtain a desired hole diameter. Therefore, by simultaneously operating a plurality of hole lap stations, fine hole machining with a high precision can be realized in a short cycle time. Furthermore, one workpiece is set at one hole lap station or a plurality of workpieces without any central shift between the outer diameter and the hole are set at one hole lap station, whereby fine hole machining can be realized without edge sagging and non-uniformity of a hole. A small grinding hem suffices at one hole lap station, so that a straight wire can be used, which also leads to the enhancement of a precision.

If a polishing material with an average particle diameter smaller than that of a polishing material used in the initial lapping process is used in the final lapping process, a large grinding hem can be obtained with a large average particle diameter in the initial lapping process, and lapping with a high precision can be realized with a small average particle diameter in the final lapping process. Thus, fine hole machining with a high efficiency and a high precision can be realized.

If a hole cleaning process of cleaning the hole of a workpiece that has been machined in lapping of the previous process is provided, ground cuttings remaining in the hole are washed away, whereby a machining efficiency and a machining precision of lapping in the subsequent process are enhanced.

Furthermore, if a hole diameter inspecting process of inspecting the hole diameter of a workpiece that has been machined in lapping of the previous process is provided, a defective product can be detected and discharged in the course of machining, and a device is stopped, whereby the cause of the defective product can be found and a procedure for solving the problem can be conducted at an early stage.

Furthermore, if the workpiece holding unit for holding a workpiece during lapping is allowed to have a function of a workpiece transport unit for transporting a workpiece with a wire passed through a hole thereof and a workpiece with a wire removed from a hole thereof, an index board that performs an index operation between a wire insertion position and a workpiece supply/discharge position is used as the workpiece transport unit, and an interstation transport device is provided, which transports a workpiece that has been lapped at the workpiece supply/discharge position to a hole lap station in the subsequent process and supplies the workpiece from a previous process, a series of lapping processes can be automated.

Furthermore, if a plurality of hole lap stations are placed at an equal interval on a circumference, the workpiece holding units are placed at an equal interval on one circumference of an index table, and a ferrule is successively sent to an adjacent hole lap station by an index operation of the index table, a series of lap processes can also be automated.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A multistage fine-hole machining method, comprising:

a first step of providing a workpiece having an inner wall surface defining a through-hole having a diameter;

a second step of passing a wire through the through-hole of the workpiece;

a third step of effecting relative sliding movement between the workpiece and the wire while providing a polishing material to at least a surface portion of the wire to thereby lap the inner surface of the workpiece with the polishing material and enlarge the diameter of the through-hole; and successively repeating the third step until the diameter of the through-hole is enlarged to a preselected diameter.

2. A method according to claim 1; wherein the step of successively repeating the third step includes the step of using a wire having a diameter greater than a diameter of the wire used in a previously performed third step or using a polishing material having an average particle diameter greater than the average particle diameter of the polishing material used in the previously performed third step.

3. A method according to claim 1; wherein the step of successively repeating the third step includes the step of using a polishing material having an average particle diameter smaller than the average particle diameter of the polishing material used in a previously performed third step.

4. A method according to claim 1; further comprising a step of cleaning the through-hole of the workpiece at least after performing one of the third steps.

5. A method according to claim 1; further comprising a step of inspecting the diameter of the through-hole of the workpiece at least after performing one of the third steps.

6. A multistage fine-hole machining device comprising: a plurality of lap stations each for lapping an inner surface defining a through-hole of a workpiece to enlarge a diameter of the through-hole, each of the lap stations having a holding unit for holding the workpiece, a wire supply unit for supplying a wire, a passing unit for passing the wire supplied from the wire supply unit through the through-hole of the workpiece, a tension applying unit for applying tension to the wire passed through the through-hole of the workpiece by the wire passing unit, a polishing material supply unit for supplying a polishing material to the wire, and a sliding unit for effecting relative sliding movement between the workpiece and the wire during a lapping operation while the workpiece is held by the holding unit, the wire is passed through the through-hole of the workpiece by the passing unit, tension is applied to the wire by the tension applying unit, and the wire is supplied with the polishing material by the polishing supply unit to thereby lap the inner surface of the workpiece with the polishing material and enlarge the diameter of the through-hole; whereby the through-hole of the workpiece is successively enlarged during lapping operations.

7. A multistage fine-hole machining device according to claim 6; further comprising a workpiece transport device for supporting the workpiece holding unit, for transporting the workpiece to a wire insertion position in which the passing unit passes the wire supplied from the wire supply unit through the through-hole of the workpiece, and for moving the workpiece from the wire insertion position.

8. A multistage fine-hole machining device according to claim 7; wherein the workpiece transport device comprises an index board for effecting index movement to move the workpiece to and from the wire insertion position and a position in which the workpiece is supplied to and discharged from the lap stations.

9. A multistage fine-hole machining device according to claim 8; further comprising an inter-station transport device for transporting the workpiece to and from each of the lap stations.

10. A multistage fine-hole machining device according to claim 7; wherein the plurality of lap stations are circumferentially spaced at equal intervals; and wherein the workpiece transport device comprises an index table having a plurality of workpiece holding units for holding respective ones of workpieces and corresponding to respective ones of the lap stations and for effecting index movement to move the workpiece holding units to the lap stations.

11. A multistage fine-hole machining device according to claim 6; further comprising a cleaning station for cleaning the through-hole of the workpiece after the inner surface of the workpiece is lapped with the polishing material.

12. A multistage fine-hole machining device according to claim 6; further comprising an inspecting station for inspecting the through-hole of the workpiece after the inner surface of the workpiece is lapped with the polishing material.

13. A multistage fine-hole machining device according to claim 6; wherein the lap stations are configured to lap the inner surface of the workpiece so that a difference in the diameter of the through-hole of the workpiece which is lapped at adjacent lap stations is smaller than the diameter of the through-hole of the workpiece which is lapped at lap stations which are not adjacent one another.

14. A multistage fine-hole machining device according to claim 6; wherein for at least one of the lap stations, the polishing material is comprised of a mixture of a plurality of types of polishing particles having different average particle diameters.

15. A multistage fine-hole machining device according to claim 6; wherein a diameter of the wire in one of the lap stations is different from a diameter of the wire in another of the lap stations.

16. A multistage fine-hole machining device according to claim 6; wherein the supply unit comprises a wire reel around which the wire is wound.

17. A multistage fine-hole machining device according to claim 6; wherein the polishing material comprises a mixture of diamond powder and oil.

18. A multistage fine-hole machining device according to claim 6; wherein the workpiece comprises a ferrule made of $ZrO_2$.

19. A multistage fine-hole machining device comprising:

a plurality of lap stations each having a holding unit for holding a workpiece having an inner surface defining a through-hole, a first supply unit for supplying a wire, a passing unit for passing the wire supplied from the first supply unit through the through-hole of the workpiece, a second supply unit for supplying a polishing material to the wire, and a sliding unit for effecting relative sliding movement between the workpiece and the wire during a lapping operation while the workpiece is held by the holding unit, the wire is passed through the through-hole of the workpiece by the passing unit, and the wire is supplied with the polishing material by the second supply unit to thereby lap the inner surface of the workpiece with the polishing material and enlarge the diameter of the through-hole; and a transfer device for successively transferring the workpiece to each of the lap stations to lap the inner surface of the workpiece at each of the lap stations during the lapping operation for successively enlarging the diameter of the through-hole to a preselected diameter.

20. A multistage fine-hole machining device according to claim 19; wherein a diameter of the wire at each of the lap stations increases for each of the lap stations in the direction in which the workpiece is successively transferred during the lapping operation.

21. A multistage fine-hole machining device according to claim 19; wherein an average particle size of the polishing material at each of the lap stations increases for each of the lap stations in the direction in which the workpiece is successively transferred during the lapping operation.

22. A multistage fine-hole machining device according to claim 19; wherein for at least one of the lap stations, the polishing material is comprised of a mixture of a plurality of types of polishing particles having different average particle diameters.

23. A multistage fine-hole machining device according to claim 19; wherein the polishing material comprises a mixture of diamond powder and oil.

24. A multistage fine-hole machining device according to claim 19; wherein the workpiece comprises a ferrule made of $ZrO_2$.

* * * * *